US011273464B2

(12) United States Patent
Shimmura et al.

(10) Patent No.: US 11,273,464 B2
(45) Date of Patent: Mar. 15, 2022

(54) SUBSTRATE PROCESSING APPARATUS

(71) Applicant: Tokyo Electron Limited, Tokyo (JP)

(72) Inventors: Satoshi Shimmura, Koshi (JP); Yuji Sakai, Koshi (JP); Kenta Shibasaki, Koshi (JP); Koji Takayanagi, Koshi (JP); Kenji Yada, Koshi (JP); Hiroichi Inada, Koshi (JP); Shinichi Seki, Koshi (JP); Kento Ogata, Koshi (JP)

(73) Assignee: TOKYO ELECTRON LIMITED, Tokyo (JP)

( * ) Notice: Subject to any disclaimer, the term of this patent is extended or adjusted under 35 U.S.C. 154(b) by 0 days.

(21) Appl. No.: 16/986,412

(22) Filed: Aug. 6, 2020

(65) Prior Publication Data

US 2021/0039131 A1 Feb. 11, 2021

(30) Foreign Application Priority Data

Aug. 7, 2019 (JP) ..... JP2019-145503

(51) Int. Cl.

| | |
|---|---|
| ***B05C 11/10*** | (2006.01) |
| ***B05B 14/30*** | (2018.01) |
| ***B05C 11/08*** | (2006.01) |
| ***B05C 13/02*** | (2006.01) |

(52) U.S. Cl.

CPC ..... *B05C 11/10* (2013.01); *B05B 14/30* (2018.02); *B05C 11/08* (2013.01); *B05C 13/02* (2013.01)

(58) Field of Classification Search

None

See application file for complete search history.

(56) References Cited

U.S. PATENT DOCUMENTS 4,856,456 A * 8/1989 Hillman ..... B05C 11/08 118/500
5,625,433 A * 4/1997 Inada ..... G03F 7/3021 396/604
5,658,615 A * 8/1997 Hasebe ..... H01L 21/67017 427/240
5,882,433 A * 3/1999 Ueno ..... H01L 21/67028 134/31

(Continued)

FOREIGN PATENT DOCUMENTS

JP 3175893 U 6/2012

*Primary Examiner* — Jethro M. Pence

(74) *Attorney, Agent, or Firm* — Pearne & Gordon LLP

(57) ABSTRACT

A substrate processing apparatus includes a cover member placed to surround a substrate held by a rotary holder; a collecting member placed in an exhaust path formed between the cover member and the rotary holder; and a solvent supply placed above the collecting member and configured to supply a solvent to the collecting member. The solvent supply includes an inner storage space surrounding the substrate; an outer storage space surrounding the inner storage space; and a partition wall extending along a circumferential direction to partition the inner storage space and the outer storage space. Multiple communication holes are extended to penetrate the partition wall such that the solvent introduced into the outer storage space flows to the inner storage space. Multiple dripping holes are extended to penetrate a bottom wall of the inner storage space such that the solvent within the inner storage space drops toward the collecting member.

12 Claims, 12 Drawing Sheets

(56) References Cited

U.S. PATENT DOCUMENTS 6,159,541 A * 12/2000 Sakai ..... G03F 7/162 427/240
6,183,810 B1 * 2/2001 Ota ..... B05D 1/005 118/320
6,238,107 B1 * 5/2001 Inada ..... G03D 5/00 396/604
6,309,116 B1 * 10/2001 Mahara ..... G03F 7/70991 396/611
6,391,110 B1 * 5/2002 Satou ..... B05C 11/08 118/52
6,419,408 B1 * 7/2002 Inada ..... G03D 5/04 396/604
7,681,521 B2 * 3/2010 Nishibayashi .... H01L 21/67754 118/66
7,891,366 B2 * 2/2011 Ito ..... H01L 21/6708 134/137
8,051,862 B2 * 11/2011 Ito ..... H01L 21/67051 134/94.1
8,469,285 B2 * 6/2013 Nakashima ..... B05C 5/0225 239/1
8,479,753 B2 * 7/2013 Nanba ..... H01L 21/67051 134/137
8,671,875 B2 * 3/2014 Nagamine ..... G03F 7/162 118/320
8,845,815 B2 * 9/2014 Ogata ..... H01L 21/67034 134/18
8,888,387 B2 * 11/2014 Matsuoka ..... H01L 21/67178 396/611
9,242,279 B2 * 1/2016 Kaneko ..... B08B 5/00
9,307,653 B2 * 4/2016 Yoshihara ..... H01L 21/67028
9,837,290 B2 * 12/2017 Nishimura ..... H01L 21/6708
9,953,826 B2 * 4/2018 Kaneko ..... H01L 21/67051
9,953,840 B2 * 4/2018 Marumoto ..... H01L 21/67028
10,394,125 B2 * 8/2019 Kawakami ..... H01L 21/0274
10,553,421 B2 * 2/2020 Ishida ..... H01L 21/6708
10,835,908 B2 * 11/2020 Kaneko ..... B05B 9/00
11,024,519 B2 * 6/2021 Fujita ..... B08B 3/10
11,049,723 B2 * 6/2021 Hiroshiro ..... H01L 21/67028
2002/0022377 A1 * 2/2002 Inada ..... H01L 21/67109 438/782
2002/0041935 A1 * 4/2002 Inada ..... B05D 3/0486 430/271.1
2002/0043214 A1 * 4/2002 Inada ..... G03F 7/3021 118/668
2005/0145168 A1 * 7/2005 Inada ..... G03F 7/162 118/416
2007/0071890 A1 * 3/2007 Yoshihara ..... H01L 21/6715 427/240
2008/0280054 A1 * 11/2008 Ogata ..... H01L 21/67051 427/425
2009/0087559 A1 * 4/2009 Yoshihara ..... G03F 7/162 427/240
2009/0181174 A1 * 7/2009 Yoshihara ..... H01L 21/6715 427/314
2009/0285991 A1 * 11/2009 Kitano ..... G03F 7/162 427/346
2010/0112209 A1 * 5/2010 Yoshihara ..... B05D 1/005 427/240
2010/0227056 A1 * 9/2010 Takayanagi ..... H01L 21/67051 427/240
2012/0276753 A1 * 11/2012 Yoshihara ..... H01L 21/0337 438/782
2014/0030423 A1 * 1/2014 Kubota ..... B05C 11/08 427/8
2014/0261163 A1 * 9/2014 Kishita ..... H01L 21/68735 118/52
2015/0064910 A1 * 3/2015 Kaneko ..... H01L 21/67051 438/694
2015/0133032 A1 * 5/2015 Kubo ..... B24B 47/16 451/5
2016/0008840 A1 * 1/2016 Sasagawa ..... B01F 15/00889 118/501
2018/0029059 A1 * 2/2018 Takahashi ..... B05C 11/08
2018/0147599 A1 * 5/2018 Tanaka ..... B05C 11/1039
2019/0255561 A1 * 8/2019 Shimmura ..... G03F 7/162

* cited by examiner

SUBSTRATE PROCESSING APPARATUS

CROSS-REFERENCE TO RELATED APPLICATION

This application claims the benefit of Japanese Patent Application No. 2019-145503 filed on Aug. 7, 2019, the entire disclosure of which is incorporated herein by reference.

TECHNICAL FIELD

The exemplary embodiments described herein pertain generally to a substrate processing apparatus.

BACKGROUND

Patent Document 1 discloses a substrate processing apparatus that includes a ring-shaped cover member placed to face a peripheral portion of a substrate held on a rotary holder and a collecting member placed in an exhaust path between the rotary holder and the cover member.

Patent Document 1: Japanese Utility Model Registration No. 3175893

SUMMARY

In one exemplary embodiment, a substrate processing apparatus includes a rotary holder configured to hold and rotate a substrate; a coating liquid supply configured to supply a coating liquid to the substrate; a cover member placed to surround the substrate held by the rotary holder; a collecting member placed in an exhaust path formed between the cover member and the rotary holder; and a solvent supply placed above the collecting member and configured to supply a solvent to the collecting member. The solvent supply includes an inner storage space configured to surround the substrate as viewed from above; an outer storage space configured to surround the inner storage space as viewed from above; and a partition wall extending along a circumferential direction of the substrate to partition the inner storage space and the outer storage space. The inner storage space includes multiple dripping holes arranged at a predetermined interval along the circumferential direction. The outer storage space includes an inlet hole through which the solvent is introduced. The partition wall includes multiple communication holes arranged at a predetermined interval along the circumferential direction. The multiple communication holes are extended to penetrate the partition wall such that the solvent introduced into the outer storage space flows to the inner storage space. The multiple dripping holes are extended to penetrate a bottom wall of the inner storage space such that the solvent within the inner storage space drops toward the collecting member.

The foregoing summary is illustrative only and is not intended to be in any way limiting. In addition to the illustrative aspects, exemplary embodiments, and features described above, further aspects, exemplary embodiments, and features will become apparent by reference to the drawings and the following detailed description.

BRIEF DESCRIPTION OF THE DRAWINGS

In the detailed description that follows, exemplary embodiments are described as illustrations only since various changes and modifications will become apparent to those skilled in the art from the following detailed description. The use of the same reference numbers in different figures indicates similar or identical items.

DETAILED DESCRIPTION

Figure 1:
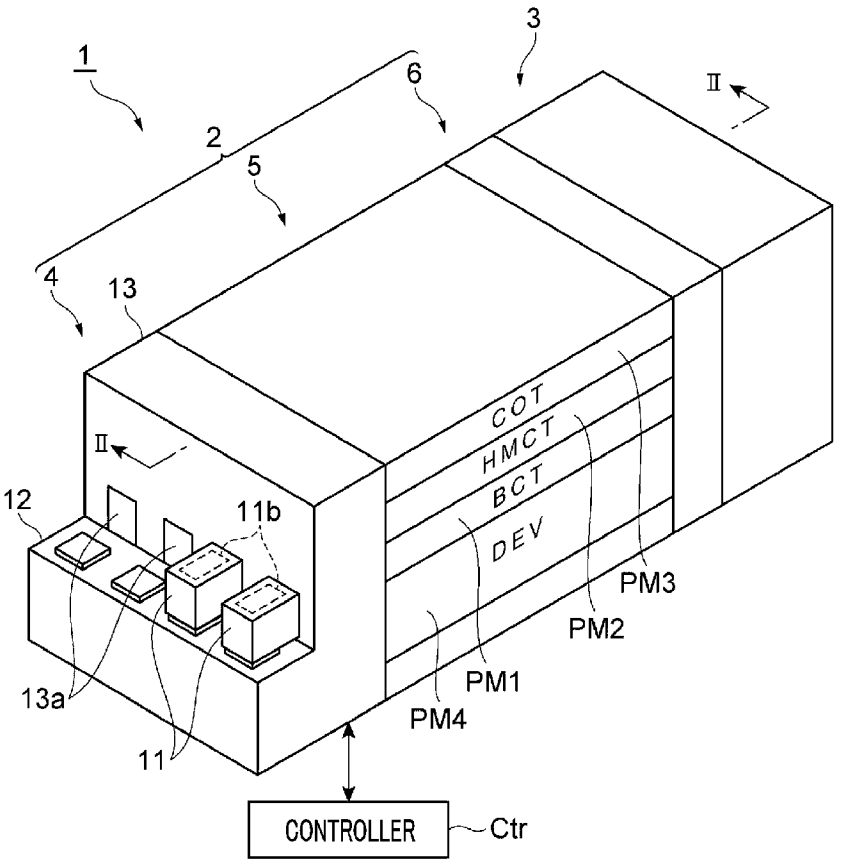
FIG. 1 is a perspective view illustrating an example of a substrate processing system.

In the following detailed description, reference is made to the accompanying drawings, which form a part of the description. In the drawings, similar symbols typically identify similar components, unless context dictates otherwise. Furthermore, unless otherwise noted, the description of each successive drawing may reference features from one or more of the previous drawings to provide clearer context and a more substantive explanation of the current exemplary embodiment. Still, the exemplary embodiments described in the detailed description, drawings, and claims are not meant to be limiting. Other exemplary embodiments may be utilized, and other changes may be made, without departing from the spirit or scope of the subject matter presented herein. It will be readily understood that the aspects of the present disclosure, as generally described herein and illustrated in the drawings, may be arranged, substituted, combined, separated, and designed in a wide variety of different configurations, all of which are explicitly contemplated herein.

Hereinafter, exemplary embodiments of the present disclosure will be described in detail with reference to the accompanying drawings. In the following description, same parts or parts having same function will be assigned same reference numerals, and redundant description will be omitted.

[Substrate Processing System]

Figure 2:
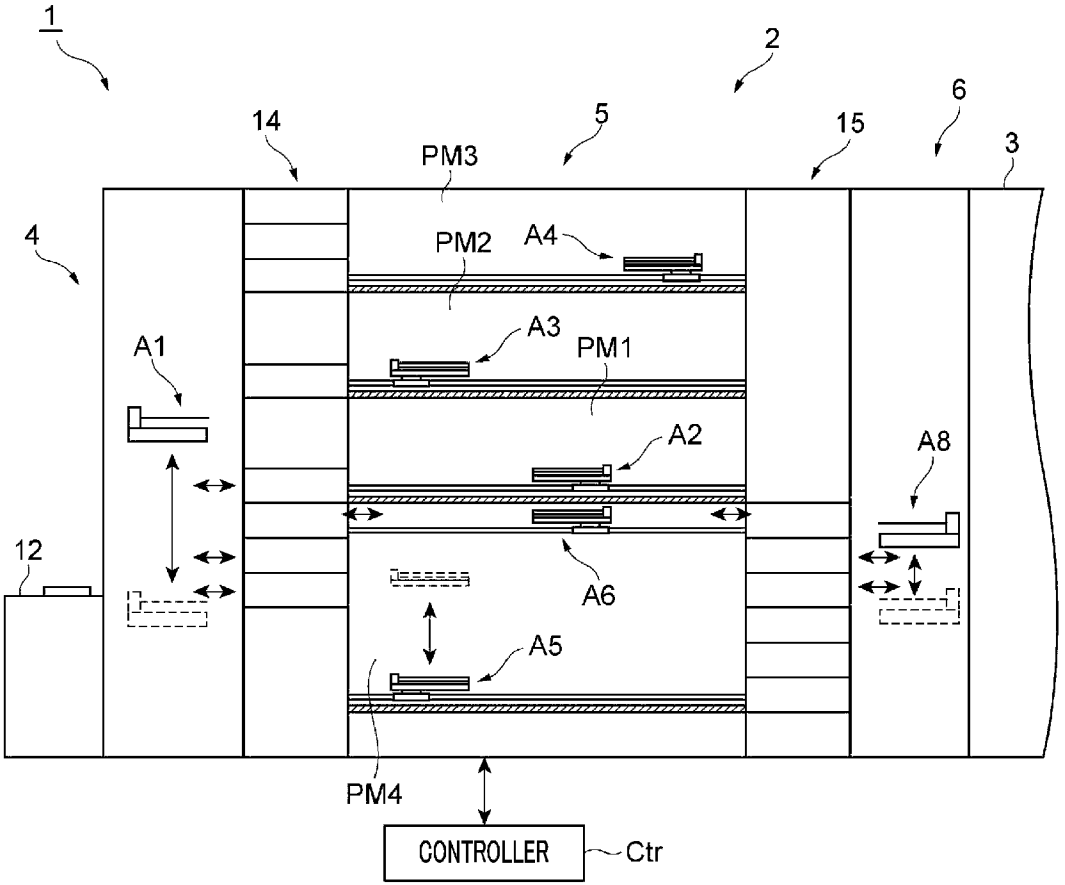
FIG. 2 is a cross-sectional view as taken along a line II-II of FIG. 1.

As illustrated in FIG. 1 and FIG. 2, a substrate processing system 1 includes a coating/developing apparatus (substrate processing apparatus) 2, an exposure apparatus 3 and a controller Ctr.

The exposure apparatus 3 is configured to perform an exposure processing (pattern exposure) of a resist film formed on a surface of a wafer (substrate) W. The exposure apparatus 3 may selectively irradiate an energy beam to an exposure target portion of the resist film (photosensitive coating film) by using a method such as liquid immersion exposure or the like.

The energy beam may be, for example, ionizing radiation or non-ionizing radiation. The ionizing radiation has sufficient energy to ionize atoms or molecules. Examples of the ionizing radiation may include extreme ultraviolet (EUV) rays, electron beams, ion beams, X-rays, α-rays, β-rays, γ-rays, heavy particle beams and photon beams. The non-ionizing radiation does not have sufficient energy to ionize atoms or molecules. Examples of the non-ionizing radiation g-rays, i-rays, KrF excimer lasers, ArF excimer lasers and $F_2$ excimer lasers.

The coating/developing apparatus 2 is configured to perform a processing of forming a resist film on the surface of the wafer W before the exposure processing by the exposure apparatus 3 and perform a processing of developing the resist film after the exposure processing. The wafer W may have a circular plate shape or a partially notched circular shape. Otherwise, the wafer W may have any shape, e.g., polygonal shape, other than the circular shape. Examples of the wafer W may include a semiconductor substrate, a glass substrate, a mask substrate, a flat panel display (FPD) substrate or other various substrates. The diameter of the wafer W may be, for example, from about 200 mm to about 450 mm.

Figure 3:
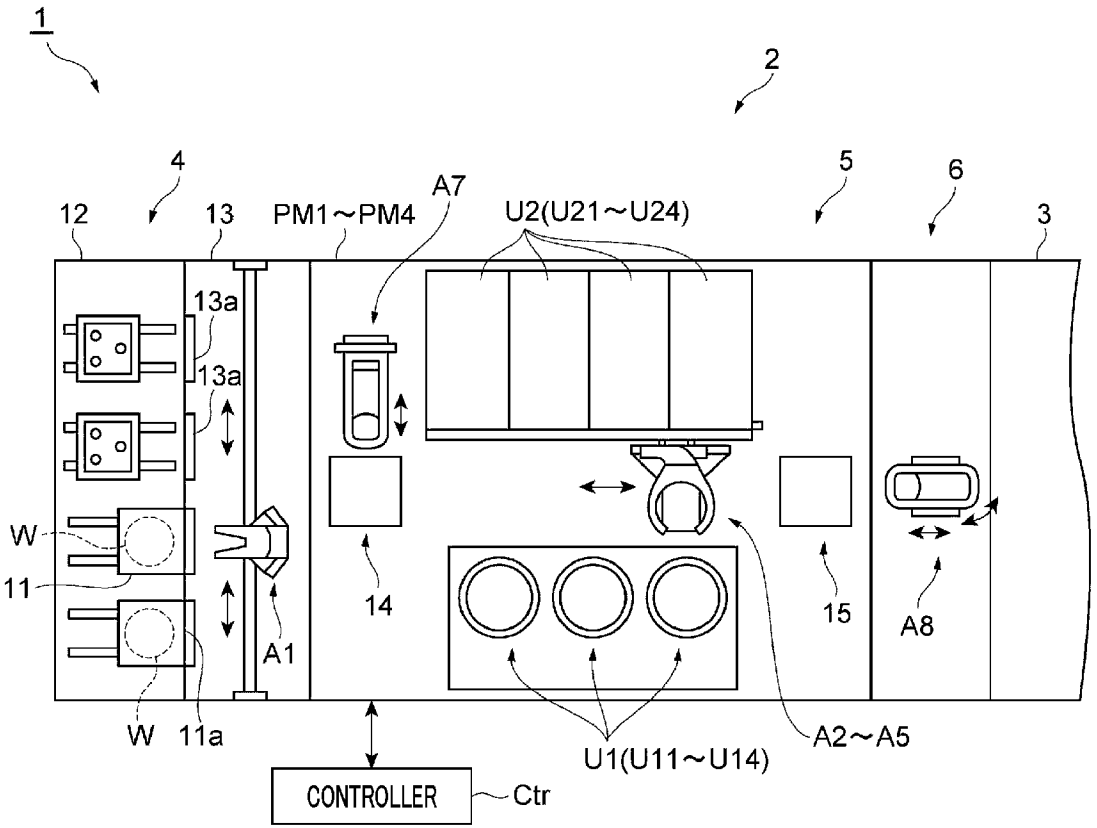
FIG. 3 is a top view illustrating an example of a processing module.

As illustrated in FIG. 1 to FIG. 3, the coating/developing apparatus 2 includes a carrier block 4, a processing block 5 and an interface block 6. The carrier block 4, the processing block 5 and the interface block 6 are arranged horizontally.

As illustrated in FIG. 1 to FIG. 3, the carrier block 4 includes a carrier station 12 and a carry-in/out section 13. The carrier station 12 is configured to support thereon a plurality of carriers 11. Each carrier 11 accommodates therein at least one wafer W in a sealed state. A side surface 11*a* of the carrier 11 is provided with an opening/closing door (not illustrated) through which the wafer W is carried into and out of the carrier 11. The carrier 11 is detachably provided on the carrier station 12 so that the side surface 11*a* faces the carry-in/out section 13.

The carry-in/out section 13 is located between the carrier station 12 and the processing block 5. The carry-in/out section 13 has a plurality of opening/closing doors 13*a*. When the carrier 11 is placed on the carrier station 12, the opening/closing door of the carrier 11 faces the opening/closing door 13*a*. By simultaneously opening the opening/closing door 13*a* and the opening/closing door of the side surface 11*a*, the inside of the carrier 11 and the inside of the carry-in/out section 13 communicate with each other. The carry-in/out section 13 includes therein a transfer arm A1. The transfer arm A1 is configured to take the wafer W out of the carrier 11 and deliver it to the processing block 5 and also receive the wafer W from the processing block 5 and return it into the carrier 11.

As illustrated in FIG. 1 to FIG. 3, the processing block 5 has processing modules PM1 to PM4. For example, the processing module PM4, the processing module PM1, the processing module PM2 and the processing module PM3 may be arranged in this sequence from the bottom.

The processing module PM1 is configured to form a base film on the surface of the wafer W and also called "BCT module". As illustrated in FIG. 2 and FIG. 3, the processing module PM1 includes therein a plurality of units U11 and U21 and a transfer arm A2 configured to transfer the wafer W to these units U11 and U21. The unit U11 is configured to, for example, coat the wafer W with a coating liquid for forming the base film. The unit U21 is configured to, for example, perform a heating processing for forming the base film by hardening the coating film formed on the wafer W by the unit U11. The base film may be, for example, an antireflection (SiARC) film.

The processing module PM2 is configured to form an intermediate film (hard mask) on the base film and also called "HMCT module". As illustrated in FIG. 2 and FIG. 3, the processing module PM2 includes therein a plurality of units U12 and U22 and a transfer arm A3 configured to transfer the wafer W to these units U12 and U22. The unit U12 is configured to, for example, coat the wafer W with a coating liquid for forming the intermediate film. The unit U22 is configured to, for example, perform a heating processing for forming the intermediate film by hardening the coating film formed on the wafer W by the unit U12. The intermediate film may be, for example, a Spin On Carbon (SOC) film or an amorphous carbon film.

The processing module PM3 is configured to form a thermosetting and photosensitive resist film on the intermediate film and also called "COT module". As illustrated in FIG. 2 and FIG. 3, the processing module PM3 includes therein a plurality of units U13 and U23 and a transfer arm A4 configured to transfer the wafer W to these units U13 and U23. The unit U13 is configured to, for example, coat the wafer W with a coating liquid for forming the resist film. The unit U23 is configured to, for example, perform a heating processing (Pre Applied Bake (PAB)) for forming the resist film by hardening the coating film formed on the wafer W by the unit U13.

The processing module PM4 is configured to perform a developing processing of the exposed resist film and also called "DEV module". As illustrated in FIG. 2 and FIG. 3, the processing module PM4 includes therein a plurality of units U14 and U24 and a transfer arm A5 configured to transfer the wafer W to these units U14 and U24. The processing module PM4 includes therein a transfer arm A6 configured to directly transfer the wafer W between shelf units 14 and 15 (which will be described later) without passing through the units U14 and U24. The unit U14 is configured to form a resist pattern by partially removing the resist film. The unit U24 is configured to, for example, perform a heating processing (Post Exposure Bake (PEB)) before the developing processing and a heating processing (Post Bake (PB)) after the developing processing.

In the following description, the units U11 to U14 will be collectively referred to as a liquid processing unit (substrate processing unit) U1 and the units U21 to U24 will be collectively referred to as a heat treatment unit U2.

As illustrated in FIG. 2 and FIG. 3, the processing block 5 includes the shelf unit 14 located at the side of the carrier block 4. The shelf unit 14 is extended from the bottom surface to the processing module PM3 and partitioned into a plurality of cells arranged in a vertical direction. A transfer arm A7 is provided near the shelf unit 14. The transfer arm A7 moves the wafer W up and down among the cells of the shelf unit 14.

The processing block 5 includes the shelf unit 15 located at the side of the interface block 6. The shelf unit 15 is extended from the bottom surface to an upper portion of the processing module PM4 and partitioned into a plurality of cells arranged in the vertical direction.

The interface block 6 includes therein a transfer arm A8 and is connected to the exposure apparatus 3. The transfer arm A8 is configured to take the wafer W out of the shelf unit 15 and deliver it to the exposure apparatus 3 and also receive the wafer W from the exposure apparatus 3 and return it into the shelf unit 15.

The controller Ctr is configured as one or more control computers and partially or entirely controls the substrate processing system 1.

[Configuration of Liquid Processing Unit]

Figure 4:
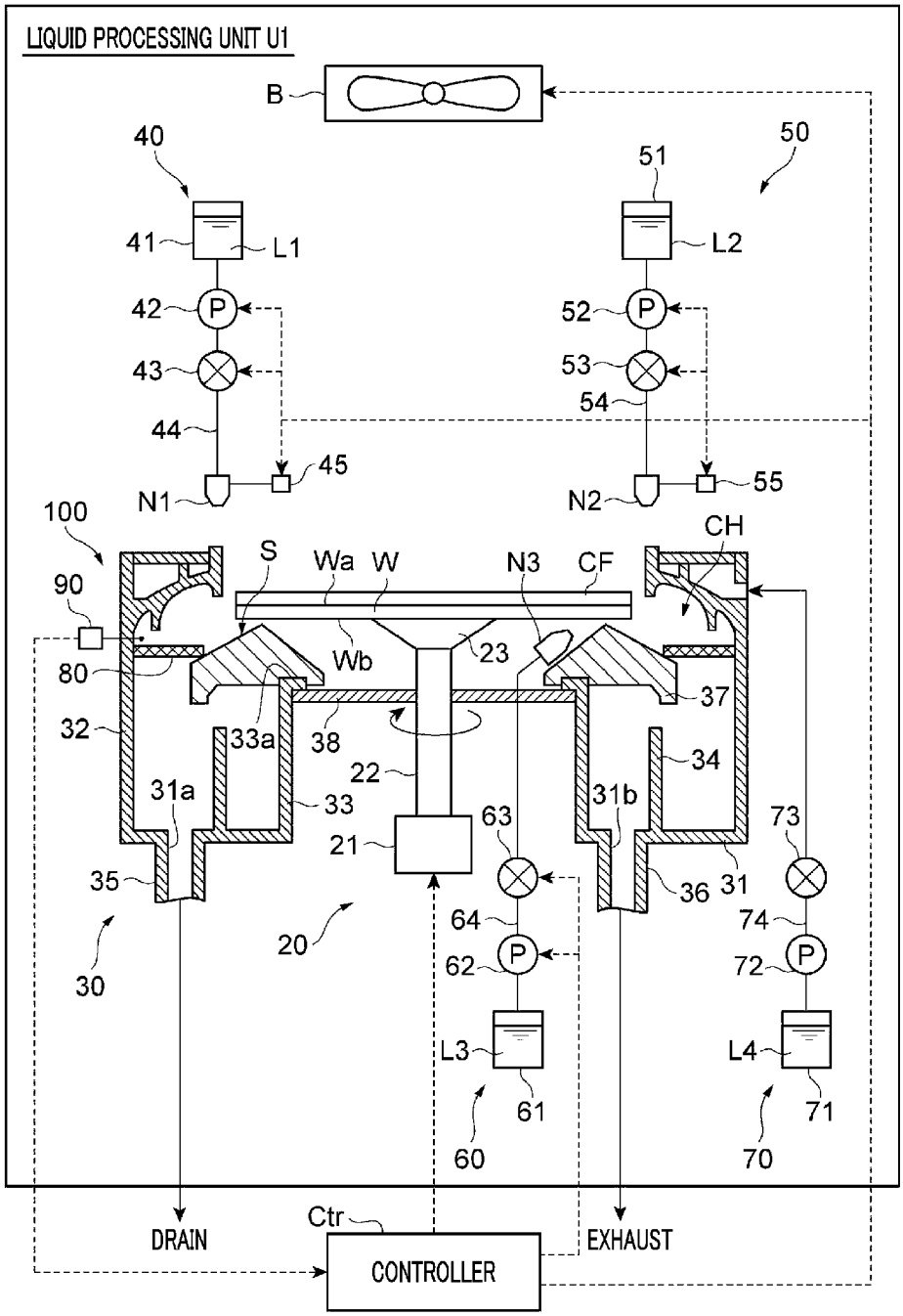
FIG. 4 is a schematic diagram illustrating an example of a liquid processing unit.

Hereinafter, the liquid processing unit U1 will be described in more detail with reference to FIG. 4 to FIG. 7. As illustrated in FIG. 4, the liquid processing unit U1 includes a rotary holder 20, a cover member 30, a coating liquid supply 40, solvent supplies 50, 60 and 70, a collecting member 80, a sensor 90 and a blower B.

The rotary holder 20 is equipped with a rotary unit 21, a shaft 22 and a holder 23. The rotary unit 21 is operated based on an operation signal from the controller Ctr and is configured to rotate the shaft 22. The rotary unit 21 is a power source such as an electric motor. The holder 23 is provided at a tip end portion of the shaft 22. The wafer W is placed on the holder 23. The holder 23 is substantially horizontally configured to hold the wafer W by, for example, suction. That is, the rotary holder 20 is configured to rotate the wafer W around a rotation axis Ax perpendicular to a front surface Wa of the wafer W in a state where the wafer W is in a substantially horizontal posture. The rotation axis Ax passes through approximately a center of the wafer W having a circular shape and thus serves as a central axis. As illustrated in FIG. 4, the rotary holder 20 may rotate the wafer W at a predetermined rotation speed clockwise as viewed from above.

The cover member 30 is provided around the rotary holder 20. The cover member 30 functions as a liquid collecting container configured to receive a liquid which is supplied to the wafer W to process the wafer W. The cover member 30 includes a bottom wall 31, an outer circumference wall 32, an inner circumference wall 33, a partition wall 34, a drain pipe 35, an exhaust pipe 36, an inclined wall 37 and a partition wall 38.

The bottom wall 31 has a circular ring shape surrounding the rotary holder 20. The outer circumference wall 32 has a cylindrical shape surrounding the inner circumference wall 33 and the inclined wall 37. The outer circumference wall 32 is extended vertically upwards from an outer circumference of the bottom wall 31. The outer circumference wall 32 is located more outside than an edge of the wafer W held on the rotary holder 20. For this reason, the outer circumference wall 32 can suppress dispersion of the liquid scattered from the wafer W held and rotated by the rotary holder 20.

The inner circumference wall 33 has a cylindrical shape surrounding the rotary holder 20. The inner circumference wall 33 is extended vertically upwards from an inner circumference of the bottom wall 31. The inner circumference wall 33 is disposed inside the edge of the wafer W held by the rotary holder 20. An upper end portion 33*a* of the inner circumference wall 33 is covered by the partition wall 38. A central portion of the partition wall 38 includes a through-hole, and the shaft 22 is inserted and penetrated through the through-hole.

The partition wall 34 has a cylindrical shape. The partition wall 34 is located between the outer circumference wall 32 and the inner circumference wall 33 and extended vertically upwards from the bottom wall 31. That is, the partition wall 34 surrounds the inner circumference wall 33. An upper end of the partition wall 34 is spaced from the inclined wall 37 located above the partition wall 34.

The inclined wall 37 is provided on the upper end portion 33*a* of the inner circumference wall 33 so as to be protruded more outwards than the partition wall 34. The inclined wall 37 has an umbrella shape (mountain shape) protruded upwards. That is, the inclined wall 37 has an inclined surface S that is inclined downwards as it goes diametrically outwards from the rotation axis of the rotary holder 20. The inclined surface S faces a peripheral portion of the wafer W held on the rotary holder 20.

The drain pipe 35 is connected to a liquid drain hole 31*a* formed on the bottom wall 31 between the outer circumference wall 32 and the partition wall 34. A liquid scattered outwards from the wafer W flows through a path CH between the outer circumference wall 32 or an outer circumference wall 102 (which will be described later) and the inclined surface S (which will be described later) of the inclined wall 37 and is guided to a space between the outer circumference wall 32 and the partition wall 34 to be drained through the liquid drain hole 31*a* and the drain pipe 35. That is, the path CH constitutes a drain path.

The exhaust pipe 36 is connected to a gas exhaust hole 31*b* formed on the bottom wall 31 between the partition wall 34 and the inner circumference wall 33. A downflow flowing on the peripheral portion of the wafer W flows through the path CH and passes through a space between an upper end portion of the partition wall 34 and the inclined wall 37 and is guided to a space between the inner circumference wall 33 and the partition wall 34 to be exhausted through the gas exhaust hole 31*b* and the exhaust pipe 36. That is, the path CH also constitutes an exhaust path.

The coating liquid supply 40 is configured to supply a coating liquid L1 onto the front surface Wa of the wafer W. The coating liquid L1 may include, for example, a photosensitive resist material for forming a photosensitive resist film, a non-photosensitive resist material for forming a non-photosensitive resist film, or the like. For example, in order to form a thick resist film R having a film thickness of about 5 μm to about 60 μm, a material (e.g., polyimide) which has a high viscosity and hardly flows on the front surface Wa of the wafer W may be used as the coating liquid L1. The lower limit of the viscosity of the coating liquid L1 may be, for example, 100 cP. The upper limit of the viscosity of the coating liquid L1 may be, for example, about 7,000 cP, about 6,000 cP, or about 5,000 cP.

The coating liquid supply 40 includes a liquid source 41, a pump 42, a valve 43, a nozzle N1, a pipe 44 and a driving mechanism 45. The liquid source 41 functions as a source of the coating liquid L1. The pump 42 is operated based on an operation signal from the controller Ctr to suck the coating liquid L1 from the liquid source 41, and sends the coating liquid L1 to the nozzle N1 via the pipe 44 and the valve 43. The valve 43 is operated based on an operation signal from the controller Ctr and opens or closes the pipe 44 where the valve 43 is provided.

The nozzle N1 is disposed above the wafer W so that a discharge opening of the nozzle N1 faces the front surface Wa of the wafer W. The nozzle N1 is configured to discharge the coating liquid L1 supplied from the pump 42 onto the front surface Wa of the wafer W. The pipe 44 connects the liquid source 41, the pump 42, the valve 43 and the nozzle N1 in this sequence from the upstream side. The driving mechanism 45 is operated based on an operation signal from the controller Ctr and moves the nozzle N1 in the horizontal and the vertical direction. The driving mechanism 45 is, for example, a servomotor equipped with an encoder, and may control a moving speed and a movement position of the nozzle N1.

The solvent supply 50 (another solvent supply) is configured to supply a solvent L2 onto the front surface Wa of the wafer W. The solvent L2 may include various kinds of thinners.

The solvent supply 50 includes a liquid source 51, a pump 52, a valve 53, a nozzle N2, a pipe 54 and a driving mechanism 55. The liquid source 51 functions as a source of the solvent L2. The pump 52 is operated based on an operation signal from the controller Ctr to suck the solvent L2 from the liquid source 51, and sends the solvent L2 to the nozzle N2 via the pipe 54 and the valve 53. The valve 53 is operated based on an operation signal from the controller Ctr and opens or closes the pipe 54 where the valve 53 is provided.

The nozzle N2 is disposed above the wafer W so that a discharge opening of the nozzle N2 faces the front surface Wa of the wafer W. The nozzle N2 is configured to discharge the solvent L2 supplied from the pump 52 onto the front surface Wa of the wafer W. The pipe 54 connects the liquid source 51, the pump 52, the valve 53 and the nozzle N2 in this sequence from the upstream side. The driving mechanism 55 is operated based on an operation signal from the controller Ctr and moves the nozzle N2 in the horizontal and the vertical directions. The driving mechanism 55 is, for example, a servomotor equipped with an encoder, and may control a moving speed and a movement position of the nozzle N2.

The solvent supply 60 (another solvent supply) is configured to supply a solvent L3 onto a rear surface Wb of the wafer W. The solvent L3 may include, for example, various kinds of thinners and may be the same as the solvent L2.

The solvent supply 60 includes a liquid source 61, a pump 62, a valve 63, a nozzle N3 and a pipe 64. The liquid source 61 functions as a source of the solvent L3. The pump 62 is operated based on an operation signal from the controller Ctr to suck the solvent L3 from the liquid source 61, and sends the solvent L3 to the nozzle N3 via the pipe 64 and the valve 63. The valve 63 is operated based on an operation signal from the controller Ctr and opens or closes the pipe 64 where the valve 63 is provided.

The nozzle N3 is disposed below the wafer W so that a discharge opening of the nozzle N3 faces the rear surface Wb of the wafer W. More specifically, the discharge opening of the nozzle N3 faces obliquely upwards so as to face the outer periphery of the wafer W. The nozzle N3 is configured to discharge the solvent L3 supplied from the pump 62 onto the rear surface Wb of the wafer W near the outer periphery of the wafer W. The pipe 64 connects the liquid source 61, the pump 62, the valve 63 and the nozzle N3 in this sequence from the upstream side.

The solvent supply 70 is configured to supply a solvent L4 to the collecting member 80. The solvent L4 may include, for example, various kinds of thinners, and may be the same as the solvent L2.

The solvent supply 70 includes a liquid source 71, a pump 72, a valve 73, a pipe 74 and a discharge member 100. The liquid source 71 functions as a source of the solvent L4. The pump 72 is operated based on an operation signal from the controller Ctr to suck the solvent L4 from the liquid source 71, and sends the solvent L4 to the discharge member 100 via the pipe 74 and the valve 73. The valve 73 is operated based on an operation signal from the controller Ctr and opens or closes the pipe 74 where the valve 73 is provided.

The discharge member 100 is located above the cover member 30 (the outer circumference wall 32). The discharge member 100 is configured to surround the peripheral portion of the wafer W held on the rotary holder 20. The discharge member 100 may have a cylindrical shape and may have an approximately C-shape. That is, the discharge member 100 may entirely surround the peripheral portion of the wafer W held on the rotary holder 20 or may partially surround the peripheral portion of the wafer W held on the rotary holder 20.

Figure 5:
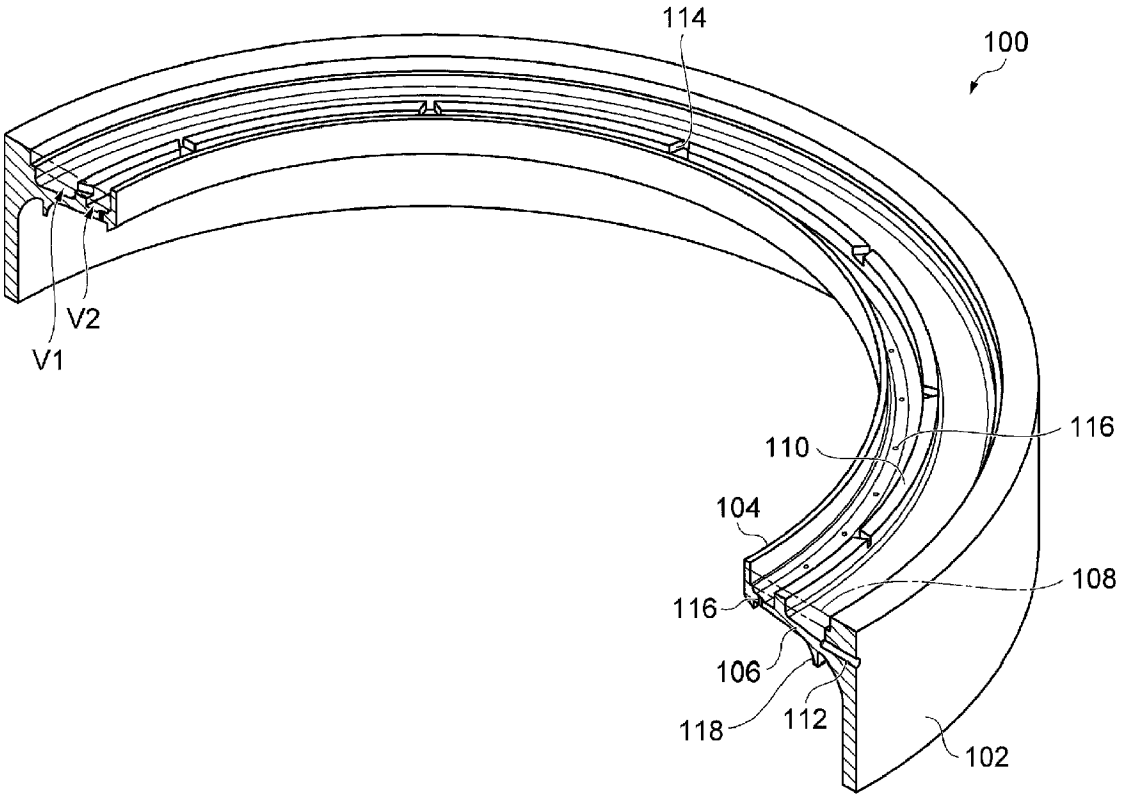
FIG. 5 is a partially cut-away perspective view illustrating an example of a discharge member.
Figure 6:
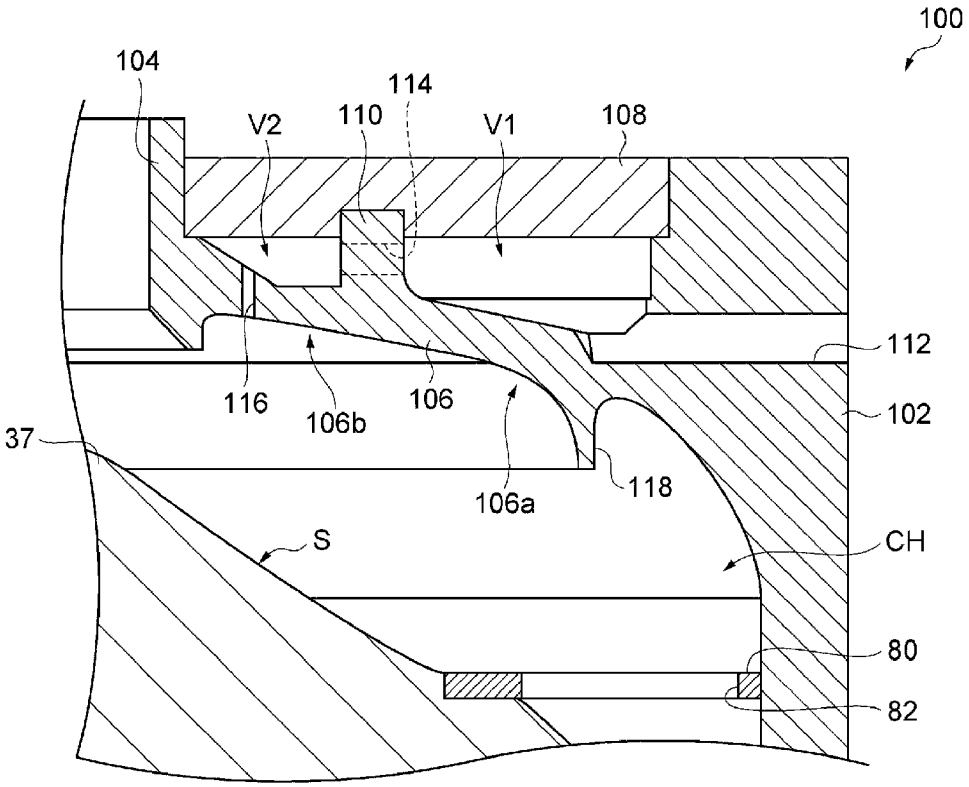
FIG. 6 is a longitudinal sectional view illustrating an example of the discharge member.

As illustrated in FIG. 5 and FIG. 6, the discharge member 100 includes an outer circumference wall 102, an inner circumference wall 104, a bottom wall 106, a ceiling wall 108 and a partition wall 110.

The outer circumference wall 102 is configured to surround the inner circumference wall 104, the bottom wall 106, the ceiling wall 108 and the partition wall 110. The outer circumference wall 102 may have a vertically extended cylindrical shape. The outer circumference wall 102 may be provided on an upper end portion of the cover member 30 (the outer circumference wall 32). The outer circumference wall 102 may be formed integrally with the cover member 30 (the outer circumference wall 32) or may be formed separately from the cover member 30 (the outer circumference wall 32).

The inner circumference wall 104 may be configured to surround the outer periphery of the wafer W held on the rotary holder 20. The inner circumference wall 104 may have a vertically extended cylindrical shape.

The bottom wall 106 is configured to connect the outer circumference wall 102 and the inner circumference wall 104. The bottom wall 106 may be inclined and extended upwards as it goes from the outer circumference wall 102 to the inner circumference wall 104. The bottom wall 106 may have a circular ring shape (ring shape). The bottom wall 106 may be formed integrally with the outer circumference wall 102 and the inner circumference wall 104 or may be formed separately from the outer circumference wall 102 and the inner circumference wall 104.

The ceiling wall 108 is configured to connect the outer circumference wall 102 and the inner circumference wall 104. The ceiling wall 108 is located above the bottom wall 106. The ceiling wall 108 may have a circular ring shape (ring shape). The ceiling wall 108 may be formed integrally with the outer circumference wall 102 and the inner circumference wall 104 or may be formed separately from the outer circumference wall 102 and the inner circumference wall 104.

The partition wall 110 is located between the outer circumference wall 102 and the inner circumference wall 104. The partition wall 110 may have a vertically extended cylindrical shape. The partition wall 110 may be formed integrally with the bottom wall 106 and may be extended vertically upwards from the bottom wall 106. The partition wall 110 may be formed integrally with the ceiling wall 108 and may be extended vertically downwards from the ceiling wall 108. The partition wall 110 may be formed separately from the bottom wall 106 and the ceiling wall 108.

The partition wall 110 is configured to partition a space surrounded by the outer circumference wall 102, the inner circumference wall 104, the bottom wall 106 and the ceiling wall 108 into two spaces in a diametrical direction of the wafer W held on the rotary holder 20 (hereinafter, simply referred to as "diametrical direction"). That is, the outer circumference wall 102, the bottom wall 106, the ceiling wall 108 and the partition wall 110 form an outer storage space V1 surrounded by them. The inner circumference wall 104, the bottom wall 106, the ceiling wall 108 and the partition wall 110 form an inner storage space V2 surrounded by them. The outer storage space V1 and the inner storage space V2 are configured to store therein the solvent L4. The outer storage space V1 is located more outside than the inner storage space V2. Each of the outer storage space V1 and the inner storage space V2 may have a circular ring shape.

The outer circumference wall 102 includes an inlet hole 112 penetrating the outer circumference wall 102 so that the outer storage space V1 can communicate with a space outside the discharge member 100. The solvent L4 sucked by the pump 72 from the liquid source 71 is introduced into the outer storage space V1 through the inlet hole 112. The inlet hole 112 may be extended in the horizontal direction.

The partition wall 110 includes a plurality of communication holes 114 penetrating the partition wall 110 so that the outer storage space V1 can communicate with the inner storage space V2. The solvent L4 within the outer storage space V1 is supplied into the inner storage space V2 through the plurality of communication holes 114. The plurality of communication holes 114 is arranged along an extension direction of the partition wall 110 (i.e., a circumferential direction of the wafer W held on the rotary holder 20) (hereinafter, simply referred to as "circumferential direction"). The plurality of communication holes 114 may be approximately equally spaced from each other side by side along the circumferential direction.

As illustrated in FIG. 5, the plurality of communication holes 114 may be increased in diameter from the outer storage space V1 to the inner storage space V2. That is, the plurality of communication holes 114 may be formed to increase in flow path area from the outer storage space V1 to the inner storage space V2. Otherwise, the plurality of communication holes 114 may be formed to be approximately uniform in the flow path area from the outer storage space V1 to the inner storage space V2.

As illustrated in FIG. 5, the inlet hole 112 may be disposed so as not to overlap any one of the plurality of communication holes 114 in the diametrical direction as viewed from above. The inlet hole 112 may be disposed so as to diametrically overlap a region of the partition wall 110 corresponding to the approximately middle of two of the plurality of communication holes 114 adjacent to each other in the circumferential direction as viewed from above. That is, the inlet hole 112 may not face the plurality of communication holes 114 but face the partition wall 110 in the diametrical direction.

A portion 106*b* (see FIG. 6) of the bottom wall 106 forming the inner storage space V2 includes a plurality of dripping holes 116 penetrating the bottom wall 106 so that the inner storage space V2 can communicate with an inner space (the path CH) of the discharge member 100. The solvent L4 introduced into the inner storage space V2 from the outer storage space V1 through the communication holes 114 drops downwards through the plurality of dripping holes 116. The plurality of dripping holes 116 is arranged along the circumferential direction. The plurality of dripping holes 116 may be approximately equally spaced from each other along the circumferential direction. The plurality of dripping holes 116 may be extended in the vertical direction.

A portion 106*a* (see FIG. 6) of the bottom wall 106 forming the outer storage space V1 may include a protrusion member 118 protruding downwards from a lower surface of the portion 106*a*. The protrusion member 118 may have a cylindrical shape and may be a protrusion having an approximately C-shape or may be composed of a plurality of arc-shaped protrusions which forms a ring shape as a whole. The protrusion member 118 may be located above the collecting member 80. The protrusion member 118 may be formed integrally with the bottom wall 106 or may be formed separately from the bottom wall 106.

The collecting member 80 is configured to collect an entangled lump. The collecting member 80 is placed to block the path CH. That is, the collecting member 80 is extended to connect the outer circumference wall 32 or the outer circumference wall 102 and the inclined surface S of the inclined wall 37. The collecting member 80 may have a circular ring shape (ring shape) (see FIG. 7) and may have an approximately C-shape.

Figure 7:
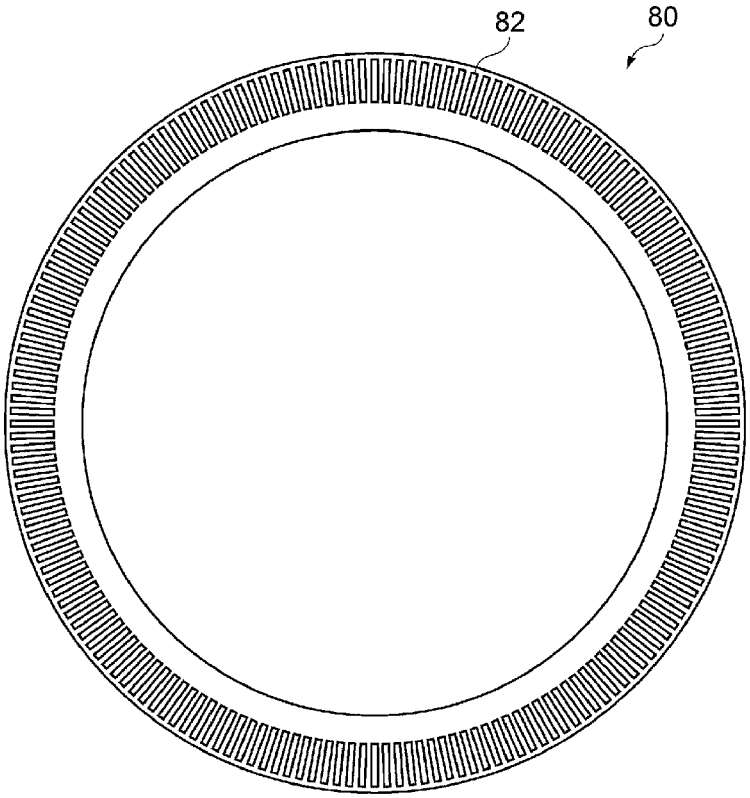
FIG. 7 is a top view illustrating an example of a collecting member.

As illustrated in FIG. 7, the collecting member 80 includes a plurality of through-holes 82. The shape of the plurality of through-holes 82 is not particularly limited. The plurality of through-holes 82 may have, for example, a rectangular shape, a circular shape or a polygonal shape. If the plurality of through-holes 82 has a rectangular shape, a longitudinal direction of each through-hole 82 may follow the diametrical direction as illustrated in FIG. 7. The plurality of through-holes 82 may be arranged along the circumferential direction as illustrated in FIG. 7.

The sensor 90 is configured to detect a status of the collecting member 80. The sensor 90 is configured to transmit the detected status of the collecting member 80 to the controller Ctr. The sensor 90 may be configured to detect, for example, a temperature of the collecting member 80. In this case, the controller Ctr may determine whether the collecting member 80 is in a dry state based on a change in the temperature of the collecting member 80 caused by heat of vaporization of the solvent. The sensor 90 may be configured to detect, for example, a humidity around the collecting member 80. In this case, the controller Ctr may determine whether the collecting member 80 is in a dry state based on a change in the humidity.

The blower B is placed at an upper portion within the liquid processing unit U1. The blower B is operated based on an operation signal from the controller Ctr and is configured to form a downflow (downward flow) flowing toward the cover member 30 and the discharge member 100.

[Configuration of Controller]

Figure 8:
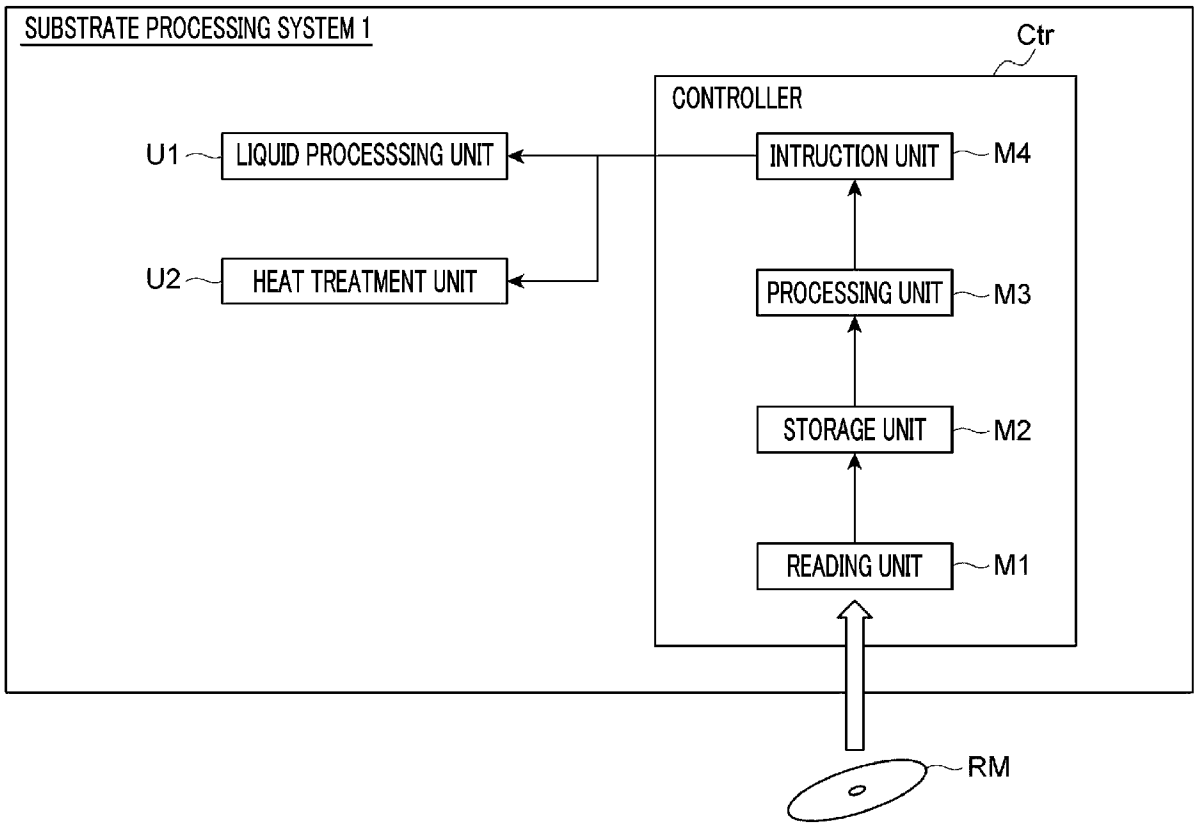
FIG. 8 is a block diagram illustrating an example of main components of the substrate processing system.

As illustrated in FIG. 8, the controller Ctr includes a reading unit M1, a storage unit M2, a processing unit M3 and an instruction unit M4 as functional modules. Although the controller Ctr has been described to be divided into these functional modules according to respective functions for convenience in description, it does not necessarily mean that the hardware constituting the controller Ctr is divided into these modules. Each functional module is not limited to being implemented by execution of a program, but may be implemented by a dedicated electric circuit (for example, a logic circuit) or an application specific integrated circuit (ASIC) into which the functional modules are combined.

The reading unit M1 is configured to read a program from a computer-readable recording medium RM. The storage unit M2 is configured to store therein process recipes, setting data inputted from an operator via an external input device (not illustrated), and the like.

The processing unit M3 is configured to process various data. The processing unit M3 generates operation signals for operating the liquid processing unit U1 and the heat treatment unit U2 based on, for example, the various data stored in the storage unit M2. The processing unit M3 may generate operation signals for operating the rotary holder 20, the pumps 42, 52, 62 and 72, the valves 43, 53, 63 and 73, and the driving mechanisms 45 and 55 based on, for example, the various data stored in the storage unit M2.

The instruction unit M4 is configured to transmit the operation signals generated in the processing unit M3 to the respective devices.

Figure 9:
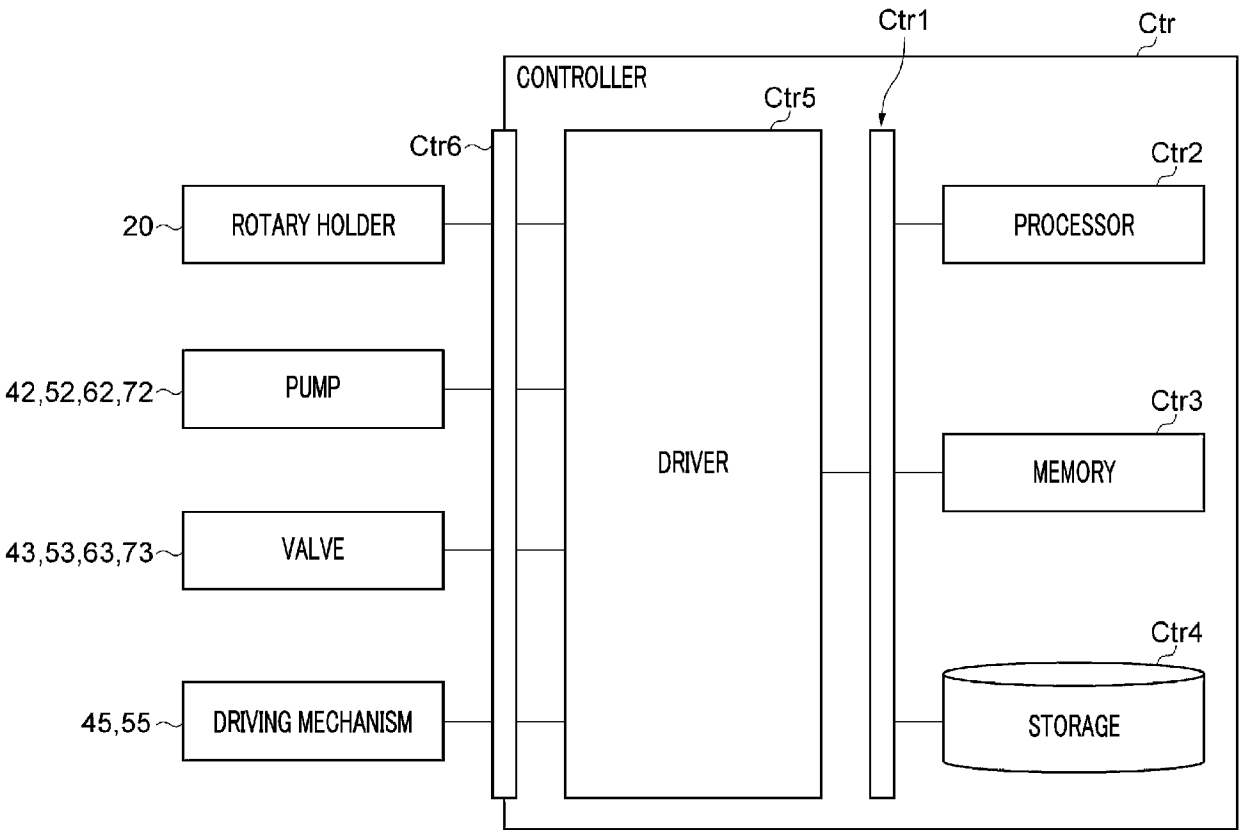
FIG. 9 is a schematic diagram illustrating an example of a hardware configuration of a controller.

The hardware of the controller Ctr is composed of, for example, one or more control computers. The controller Ctr includes, for example, a circuit Ctr1 illustrated in FIG. 9 as a hardware component. The circuit Ctr1 may be composed of electronic circuit elements (circuitry). Specifically, the circuit Ctr1 includes a processor Ctr2, a memory Ctr3 (storage unit), a storage Ctr4 (storage unit), a driver Ctr5 and an input/output port Ctr6. The processor Ctr2 constitutes each of the above-described functional modules by executing a program in cooperation with at least one of the memory Ctr3 and the storage Ctr4 and executing input and output operations of signals via the input/output port Ctr6. The memory Ctr3 and the storage Ctr4 function as the storage unit M2. The driver Ctr5 is a circuit configured to drive various devices of the substrate processing system 1. The input/output port Ctr6 performs the input and output operations of signals between the driver Ctr5 and various devices (for example, the rotary holder 20, the pumps 42, 52, 62 and 72, the valves 43, 53, 63 and 73, the driving mechanisms 45 and 55, etc.) of the substrate processing system 1.

In the present exemplary embodiment, the substrate processing system 1 includes the single controller Ctr. However, the substrate processing system 1 may include a controller group composed of a plurality of controllers Ctr. If the substrate processing system 1 includes the controller group, each of the above-described functional modules may be implemented by a single controller Ctr or by a combination of two or more controllers Ctr. If the controller Ctr is composed of a plurality of computers (circuits Ctr1), each of the above-described functional modules may be implemented by a single computer (circuit Ctr1) or by a combination of two or more computers (circuits Ctr1). The controller Ctr may include a plurality of processors Ctr2. In this case, each of the above-described functional modules may be implemented by a single processor Ctr2 or by a combination of two or more processors Ctr2.

[Wafer Processing Method]

A method of processing the wafer W will be described with reference to FIG. 10. First, the controller Ctr controls the pump 72 and the valve 73 to supply the solvent L4 from the discharge member 100 to the collecting member 80 (see process S11 in FIG. 10). For example, the solvent L4 sucked by the pump 72 from the liquid source 71 is introduced into the outer storage space V1 through the inlet hole 112. Thus, the outer storage space V1 is filled with the solvent L4. While the outer storage space V1 is filled with the solvent L4, the solvent L4 is introduced into the inner storage space V2 through the communication holes 114. Thus, the inner storage space V2 is also filled with the solvent L4.

While the inner storage space V2 is filled with the solvent L4, when the solvent L4 reaches the plurality of dripping holes 116, the solvent L4 is discharged from the lower ends of the plurality of dripping holes 116. The solvent L4 discharged from the lower ends of the plurality of dripping holes 116 does not drop immediately but flows toward the protrusion member 118 along the lower surface of the bottom wall 106 due to surface tension. When the solvent L4 reaches the protrusion member 118, the solvent L4 is collected at the lower end of the protrusion member 118. When the amount of the solvent L4 collected at the lower end of the protrusion member 118 exceeds a predetermined amount, the solvent L4 drops from the lower end of the protrusion member 118. Thus, the solvent L4 is supplied to the collecting member 80 located under the protrusion member 118. For this reason, if the entangled lump is present on the collecting member 80, the solvent L4 is supplied to the entangled lump, so that the entangled lump is dissolved to be removed.

Figure 10:
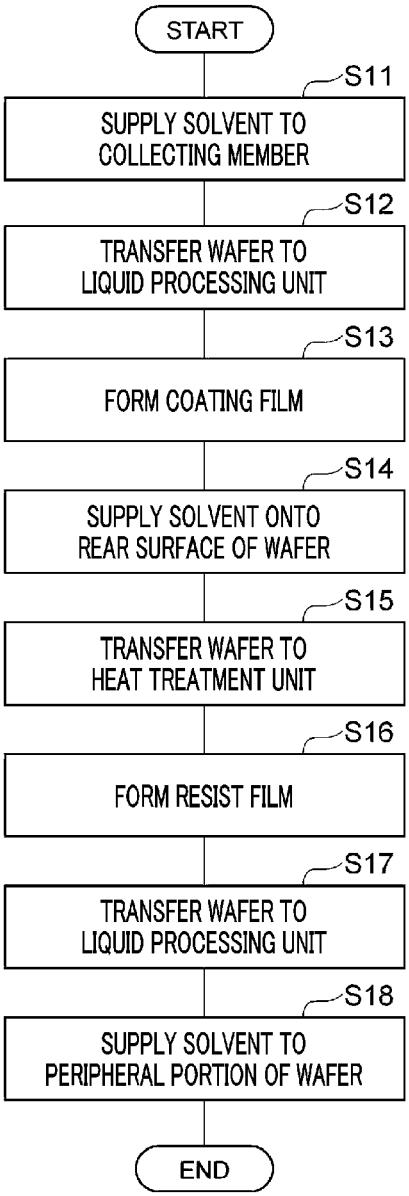
FIG. 10 is a flowchart provided to explain a sequence of processings performed on a wafer.

Then, the controller Ctr controls each component of the substrate processing system 1 to transfer the wafer W from the carrier 11 to the liquid processing unit U1 (see process S12 in FIG. 10).

Then, the controller Ctr controls the rotary holder 20 to hold the wafer on the holder 23 and rotate the wafer W at a predetermined rotation number. In this state, the controller Ctr controls the pump 42, the valve 43 and the driving mechanism 45 to discharge the coating liquid L1 from the nozzle N1 onto the front surface Wa of the wafer W. Thus, the coating liquid L1 slowly spreads toward the outer periphery of the front surface Wa of the wafer W. Thus, the coating liquid L1 is dried to be gelated, and a coating film CF is formed on the front surface Wa of the wafer W (see process S13 in FIG. 10).

Then, the controller Ctr controls the pump 62 and the valve 63 to supply the solvent L3 from the nozzle N3 onto the rear surface Wb of the wafer W near an edge portion We of the wafer W (see process S14 in FIG. 10). The solvent L3 which has reached the edge portion flows more outwards while slightly spinning along the edge portion. In this case, a portion protruding from the coating film CF to the edge portion is removed by the solvent L3.

Then, the controller Ctr controls each component of the substrate processing system 1 to transfer the wafer W from the liquid processing unit U1 to the heat treatment unit U2 (see process S15 in FIG. 10). Thereafter, the controller Ctr controls the heat treatment unit U2 to heat the wafer W and the coating film CF. Thus, the coating film CF is solidified and becomes the resist film (see process S16 in FIG. 10). Thus, the processing of the wafer W is completed and the resist film is formed on the front surface Wa of the wafer W.

Then, the controller Ctr controls each component of the substrate processing system 1 to transfer the wafer W from the heat treatment unit U2 to the liquid processing unit U1 (see process S17 in FIG. 10). Then, the controller Ctr controls the rotary holder 20 to rotate the wafer W at a predetermined rotation number. Also, the controller Ctr controls the pump 52, the valve 53 and the driving mechanism 55 to discharge the solvent L2 downwards (toward the peripheral portion of the wafer W) from the nozzle N2 in a state where the nozzle N2 is located above the peripheral portion of the wafer W as viewed from above (see process S18 in FIG. 10). Thus, a peripheral portion (hump portion) of the resist film is removed. The processes S17 and S18 may be performed in a case where the viscosity of the coating liquid L1 is higher than a predetermined level or may not be necessarily performed.

In the above-described method of processing the wafer W, the solvent L2 may be supplied to the peripheral portion of the wafer W before the solvent L3 is supplied to the rear surface Wb of the wafer W near the edge portion Wc of the wafer W. The supply of the solvent L3 to the rear surface Wb of the wafer W near the edge portion Wc of the wafer W may be performed simultaneously with the supply of the solvent L2 to the peripheral portion of the wafer W. At least one of the supply of the solvent L3 to the rear surface Wb of the wafer W near the edge portion Wc of the wafer W and the supply of the solvent L2 to the peripheral portion of the wafer W may be performed.

In the above-described method of processing the wafer W, the process S11 may be performed after the process S18. In this case, the process S11 may be performed only after a last one wafer of at least one wafer W accommodated in the carrier 11 is processed in the process S18. The process S11 may be performed in a state where the wafer W is not present within the cover member 30 or in a state where the wafer W is present within the cover member 30 (for example, in a state where the wafer W is held on the holder 23).

[Effects]

According to the above-described exemplary embodiment, the solvent L4 introduced into the outer storage space V1 from the inlet hole 112 fills the outer storage space V1, and then, passes through the plurality of communication holes 114 to be slowly supplied into the inner storage space V2. Here, the plurality of communication holes 114 is provided in the partition wall 110 at a predetermined interval along the circumferential direction, and, thus, the pressure of the solvent L4 introduced into the inner storage space V2 becomes approximately uniform. For this reason, the flow rate of the solvent L4 dropping from the plurality of dripping holes 116 becomes approximately uniform. Therefore, the solvent L4 is supplied approximately uniformly throughout the collecting member 80. Accordingly, it is possible to effectively remove the entangled lump collected in the collecting member 80.

According to the above-described example, the discharge member 100 may include the protrusion member 118 protruding from the lower surface of the bottom wall 106 toward the collecting member 80 located under the bottom wall 106. In this case, even when the solvent L4 discharged from the dripping holes 116 does not drop immediately but flows along the lower surface of the bottom wall 106, the solvent L4 is collected at the protrusion member 118 and then drops from the lower end portion of the protrusion member 118 toward the collecting member 80. Also, when the solvents L2 and L3 are supplied to the rear surface Wb or the peripheral portion of the wafer W, the solvents L2 and L3 scattered from the wafer W as the wafer W rotates collide with the protrusion member 118 and then drop from the protrusion member 118 toward the collecting member 80. Therefore, it is possible to more effectively supply the solvents to the collecting member 80.

According to the above-described exemplary embodiment, the plurality of communication holes 114 may be increased in the diameter from the outer storage space V1 to the inner storage space V2. In this case, when the solvent L4 is introduced into the inner storage space V2 from the communication holes 114, the flow velocity of the solvent L4 is decreased. For this reason, it becomes easy for the solvent L4 introduced into the inner storage space V2 to spread within the inner storage space V2 with a good balance. Therefore, the flow rate of the solvent L4 dropping from the plurality of dripping holes 116 becomes more uniform. Accordingly, it is possible to more effectively remove the entangled lump collected in the collecting member 80.

According to the above-described exemplary embodiment, the inlet hole 112 may be disposed so as not to overlap any one of the plurality of communication holes 114 in the diametrical direction as viewed from above. In this case, it is possible to suppress the solvent L4, which has been introduced into the outer storage space V1 from the inlet hole 112, from being immediately flown into a specific communication hole 114, so that an easy introduction of the solvent L4 into the inner storage space V2 from the specific communication hole 114 can be suppressed. For this reason, it becomes easy for the solvent L4 to be more uniformly introduced into the inner storage space V2. Therefore, the flow rate of the solvent L4 dropping from the plurality of dripping holes 116 becomes more uniform. Accordingly, it is possible to more effectively remove the entangled lump collected in the collecting member 80.

According to the above-described exemplary embodiment, the inlet hole 112 may be disposed so as to diametrically overlap the region of the partition wall 110 corresponding to the approximately middle of two of the plurality of communication holes 114 adjacent to each other in the circumferential direction as viewed from above. In this case, the solvent L4 introduced from the inlet hole 112 collides first with the partition wall 110 and then flows along the circumferential direction to fill the outer storage space V1. For this reason, it becomes easy for the solvent L4 to be more uniformly introduced into the inner storage space V2.

According to the above-described exemplary embodiment, the coating liquid L1 may have a viscosity of 100 cP or more. In this case, even when the coating liquid L1 having a high viscosity at which the entangled lump can be easily generated is used, it is possible to suppress the generation of the entangled lump.

MODIFICATION EXAMPLES

The exemplary embodiments disclosed herein are illustrative in all aspects and do not limit the present disclosure. Further, the above-described exemplary embodiments may be omitted, substituted, or changed in various forms without departing from the scope and spirit of the appended claims.

Figure 11:
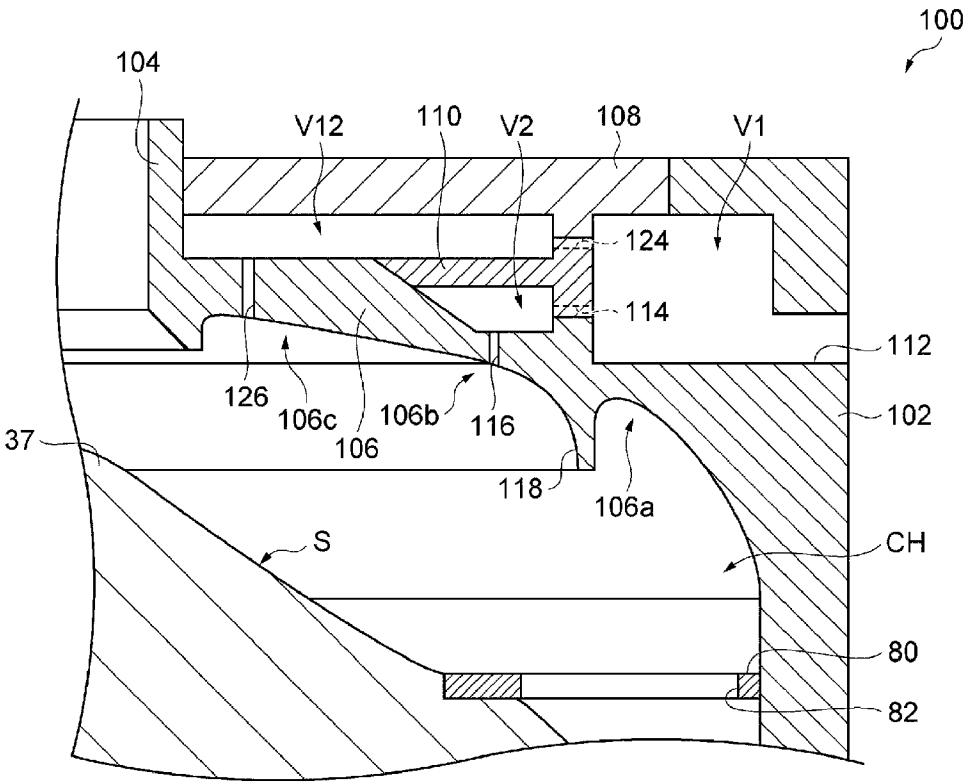
FIG. 11 is a longitudinal sectional view illustrating another example of the discharge member.

(1) The discharge member 100 may include a plurality of inner storage spaces. For example, the discharge member 100 may include the inner storage space V2 and may further include an inner storage space V12 (another inner storage space) located above the inner storage space V2 to surround the wafer W as viewed from above. As illustrated in FIG. 11, the outer storage space V1, the inner storage space V2 and the inner storage space V12 may be partitioned by the partition wall 110.

The inner storage space V2 may be formed by a space surrounded by the bottom wall 106 and the partition wall 110. The inner storage space V12 may be formed by a space surrounded by the inner circumference wall 104, the bottom wall 106, the ceiling wall 108 and the partition wall 110.

In addition to the plurality of communication holes 114, the partition wall 110 may further include a plurality of communication holes 124 (other communication holes) penetrating the partition wall 110 so that the outer storage space V1 can communicate with the inner storage space V12. The solvent L4 within the outer storage space V1 is supplied into the inner storage space V2 through the plurality of communication holes 114 and also supplied into the inner storage space V12 through the plurality of communication holes 124. The plurality of communication holes 124 is arranged along the circumferential direction. The plurality of communication holes 124 may be approximately equally spaced from each other along the circumferential direction.

A portion 106*c* of the bottom wall 106 forming the inner storage space V12 includes a plurality of dripping holes 126 (other dripping holes) penetrating the bottom wall 106 so that the inner storage space V12 can communicate with the inner space (the path CH) of the discharge member 100. The solvent L4 introduced into the inner storage space V12 from the outer storage space V1 through the communication holes 124 drops downwards through the plurality of dripping holes 126. The plurality of dripping holes 126 is arranged along the circumferential direction. The plurality of dripping holes 126 may be approximately equally spaced from each other along the circumferential direction. The plurality of dripping holes 126 may be extended in the vertical direction. Lower ends (discharge holes) of the plurality of dripping holes 126 may be located above the inclined surface S of the inclined wall 37, or may be located above the collecting member 80.

According to the example illustrated in FIG. 11, the solvent L4 is discharged from each of the dripping holes 116 and 126, and, thus, the solvent L4 is supplied not only to the collecting member 80 but also to an inner wall surface (the inclined surface S of the inclined wall 37) of the cover member 30. Therefore, it is possible to effectively remove the entangled lump on the inclined surface S.

Figure 12:
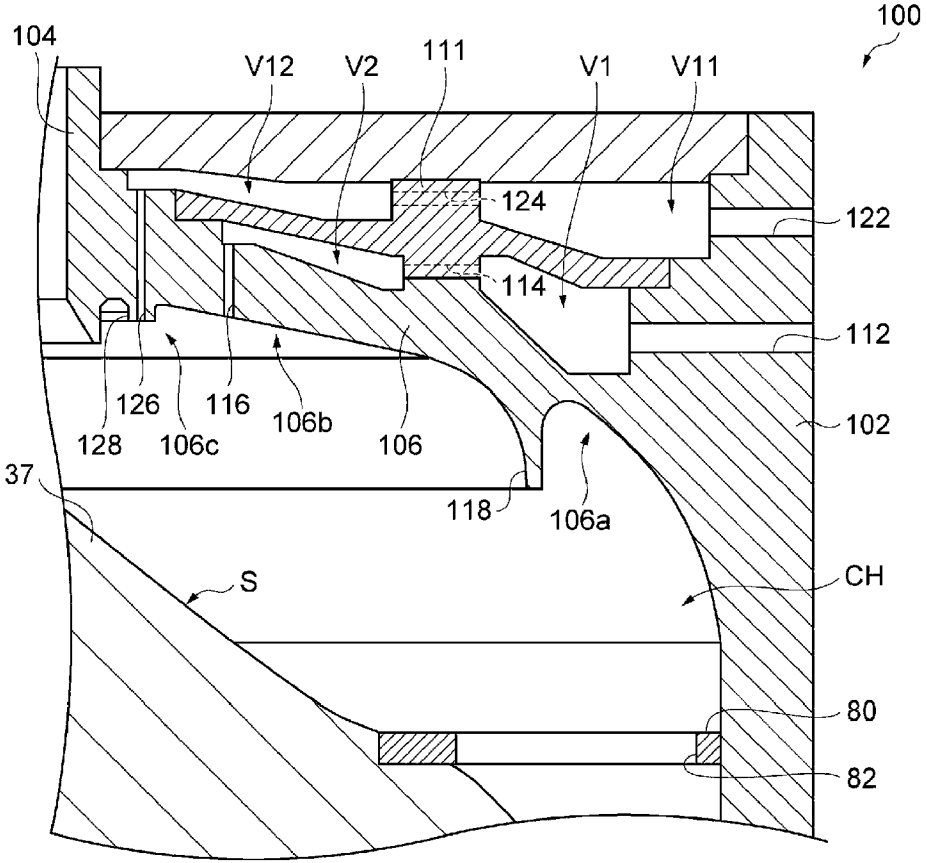
FIG. 12 is a longitudinal sectional view illustrating yet another example of the discharge member.

(2) The discharge member 100 may include a plurality of outer storage spaces and a plurality of inner storage spaces. For example, the discharge member 100 may further include the inner storage space V12 (another inner storage space) located above the inner storage space V2 to surround the wafer W as viewed from above, and an outer storage space V11 (another outer storage space) located above the outer storage space V1 to surround the inner storage space V12 as viewed from above. As illustrated in FIG. 12, the outer storage space V1, the inner storage space V2, the outer storage space V11 and the inner storage space V12 may be partitioned by the partition wall 110.

The outer storage space V1 may be formed by a space surrounded by the outer circumference wall 102, the bottom wall 106 and the partition wall 110. The outer storage space V11 may be formed by a space surrounded by the outer circumference wall 102, the ceiling wall 108 and the partition wall 110. The inner storage space V2 may be formed by a space surrounded by the bottom wall 106 and the partition wall 110. The inner storage space V12 may be formed by a space surrounded by the inner circumference wall 104, the bottom wall 106, the ceiling wall 108 and the partition wall 110.

The outer circumference wall 102 may include an inlet hole 122 (another inlet hole) penetrating the outer circumference wall 102 so that the outer storage space V11 can communicate with the outer space of the discharge member 100. The solvent L4 sucked by the pump 72 from the liquid source 71 is introduced into the outer storage space V1 through the inlet hole 112 and also introduced into the outer storage space V11 through the inlet hole 122. The inlet hole 122 may be extended in the horizontal direction.

In addition to the plurality of communication holes 114, the partition wall 110 may further include the plurality of communication holes 124 (other communication holes) penetrating the partition wall 110 so that the outer storage space V11 can communicate with the inner storage space V12. The solvent L4 within the outer storage space V1 is supplied into the inner storage space V2 through the plurality of communication holes 114. The solvent L4 within the outer storage space V11 is supplied into the inner storage space V12 through the plurality of communication holes 124. The plurality of communication holes 124 is arranged along the circumferential direction. The plurality of communication holes 124 may be approximately equally spaced from each other along the circumferential direction.

The inlet hole 122 may be disposed so as not to overlap any one of the plurality of communication holes 124 in the diametrical direction as viewed from above. The inlet hole 112 may be disposed so as to diametrically overlap a region of the partition wall 110 corresponding to the approximately middle of two of the plurality of communication holes 124 adjacent to each other in the circumferential direction as viewed from above. That is, the inlet hole 112 may not face the plurality of communication holes 124 but face the partition wall 110 in the diametrical direction.

The portion 106*c* of the bottom wall 106 forming the inner storage space V12 includes the plurality of dripping holes 126 (other dripping holes) penetrating the bottom wall 106 so that the inner storage space V12 can communicate with the inner space (the path CH) of the discharge member 100. The solvent L4 introduced into the inner storage space V12 from the outer storage space V11 through the communication holes 124 drops downwards through the plurality of dripping holes 126. The plurality of dripping holes 126 is arranged along the circumferential direction. The plurality of dripping holes 126 may be approximately equally spaced from each other along the circumferential direction. The plurality of dripping holes 126 may be extended in the vertical direction. The lower ends (discharge holes) of the plurality of dripping holes 126 may be located above the inclined surface S of the inclined wall 37, or may be located above the collecting member 80.

According to the example illustrated in FIG. 12, the solvent L4 is discharged from each of the dripping holes 116 and 126, and, thus, the solvent L4 is supplied not only to the collecting member 80 but also to the inner wall surface (the inclined surface S of the inclined wall 37) of the cover member 30. Therefore, it is possible to effectively remove the entangled lump on the inclined surface S. Also, according to the example illustrated in FIG. 12, the solvent L4 flowing through the outer storage space V1 and the inner storage space V2 and the solvent L4 flowing through the outer storage space V11 and the inner storage space V12 are independent of each other. Therefore, the flow rate of the solvent L4 discharged from the dripping holes 116 and the flow rate of the solvent L4 discharged from the dripping holes 126 do not affect each other. Thus, the flow rate of the solvent L4 dropping from the dripping holes 116 and the flow rate of the solvent L4 dropping from the dripping holes 126 become approximately uniform. Accordingly, it is possible to more effectively remove the entangled lump.

(3) As illustrated in FIG. 12, a portion 106*c* of the bottom wall 106 forming the inner storage space V12 may include a protrusion member 128 (another protrusion member) protruding downwards from the lower surface of the portion 106*c*. The protrusion member 128 may have a cylindrical shape and may be a protrusion having an approximately C-shape or may be composed of a plurality of circular arc-shaped protrusions which forms a ring shape as a whole. The protrusion member 128 may be located above the inclined surface S of the inclined wall 37. The protrusion member 128 may be formed integrally with the bottom wall 106 or may be formed separately from the bottom wall 106.

According to this example, the solvent L4 discharged from the dripping holes 126 is hardly attracted to the solvent L4 discharged from the dripping holes 116 due to the surface tension, and, thus, it becomes easy for the solvent L4 to drop downwards from a lower end of the protrusion member 128. For this reason, the solvent L4 can effectively drop from the dripping holes 126 to the inner wall surface (the inclined surface S of the inclined wall 37) of the cover member 30. Therefore, it is possible to more effectively remove the entangled lump on the inclined surface S.

(4) The timing for supplying the solvent L4 from the solvent supply 70 (the discharge member 100) to the collecting member 80 is not particularly limited. For example, when the collecting member 80 is in the dry state, the controller Ctr may control the pump 72 and the valve 73 to supply the solvent L4 to the collecting member 80 from the discharge member 100. In this case, when the solvent L4 is needed, the solvent is supplied to the collecting member 80.

Therefore, it is possible to reduce the consumption amount of the solvent L4 and effectively remove the entangled lump.

For example, when a predetermined time period (for example, about 40 seconds to about 60 seconds) has elapsed after the solvent is supplied to the collecting member 80, the controller Ctr may control the solvent supply 70 to supply the solvent L4 to the collecting member 80. For example, when a new solvent is not supplied from the solvent supply 50 or the solvent supply 60 while a predetermined time period elapses after the solvent is supplied to the collecting member 80, the controller Ctr may control the solvent supply 70 to supply the solvent L4 to the collecting member 80. In this case, by setting the predetermined time period to be shorter than a time period during which the solvent is vaporized, before the collecting member 80 is dried, the solvent is automatically supplied to the collecting member 80. Therefore, it is possible to reduce the consumption amount of the solvent and effectively and automatically remove the entangled lump. The predetermined time period of may be, for example, about 40 seconds to about 60 seconds.

For example, when the sensor 90 detects that the collecting member 80 is in the dry state, the controller Ctr may control the solvent supply 70 to supply the solvent L4 to the collecting member 80. In this case, the dry state of the collecting member 80 can be more accurately detected by the sensor 90. For this reason, before the collecting member 80 is dried, the minimum required amount of the solvent is automatically supplied to the collecting member 80. Therefore, it is possible to further reduce the consumption amount of the solvent and effectively and automatically remove the entangled lump.

(5) A height position of a region of the bottom surface of the inner storage space V2 in which the dripping hole 116 is formed may be higher than a height position of the other region of the bottom surface of the inner storage space V2. In this case, immediately after the operation of the pump 72 is stopped and the solvent L4 is not supplied to the outer storage space V1 and the inner storage space V2, the dropping of the solvent L4 from the dripping hole 116 is also stopped. Therefore, it is possible to control the dropping of the solvent L4 from the dripping hole 116 with higher accuracy. The height position of the region of the bottom surface of the inner storage space V2 in which the dripping hole 116 is formed may be equal to or lower than the height position of the other region of the bottom surface of the inner storage space V2. A height position of a region of a bottom surface of the inner storage space V12 in which the dripping hole 126 is formed may be set in the same manner as described above.

Another Example

Example 1. A substrate processing apparatus according to the exemplary embodiment includes a rotary holder configured to hold and rotate a substrate; a coating liquid supply configured to supply a coating liquid to the substrate; a cover member placed to surround the substrate held by the rotary holder; a collecting member placed in an exhaust path formed between the cover member and the rotary holder; and a solvent supply placed above the collecting member and configured to supply a solvent to the collecting member. The solvent supply includes an inner storage space configured to surround the substrate as viewed from above; an outer storage space configured to surround the inner storage space as viewed from above; and a partition wall extending along a circumferential direction of the substrate to partition the inner storage space and the outer storage space. The inner storage space includes multiple dripping holes arranged at a predetermined interval along the circumferential direction. The outer storage space includes an inlet hole through which the solvent is introduced. The partition wall includes multiple communication holes arranged at a predetermined interval along the circumferential direction. The multiple communication holes are extended to penetrate the partition wall such that the solvent introduced into the outer storage space flows to the inner storage space. The multiple dripping holes are extended to penetrate a bottom wall of the inner storage space such that the solvent within the inner storage space drops toward the collecting member. In this case, the solvent introduced into the outer storage space from the inlet hole fills the outer storage space, and then, passes through the multiple communication holes to be slowly supplied into the inner storage space. Here, the multiple communication holes are provided in the partition wall at the predetermined interval along the circumferential direction, and, thus, the pressure of the solvent introduced into the inner storage space becomes approximately uniform. For this reason, the flow rate of the solvent dropping from the multiple dripping holes becomes approximately uniform. Therefore, the solvent is supplied approximately uniformly throughout the collecting member. Accordingly, it is possible to effectively remove the entangled lump collected in the collecting member.

Example 2. In the substrate processing apparatus of Example 1, the solvent supply may further include a protrusion member protruding from a lower surface of a bottom wall of the solvent supply toward the collecting member located under the bottom wall. In this case, even when the solvent discharged from the multiple dripping holes does not drop downwards immediately but flows along the lower surface of the bottom wall of the solvent supply, the solvent is collected at the protrusion member and then drops from the lower end portion of the protrusion member toward the collecting member. Also, for example, when the solvent is supplied to the rear surface or the peripheral portion of the substrate, the solvent scattered from the substrate as the substrate rotates collides with the protrusion member and then drops from the protrusion member toward the collecting member. Therefore, it is possible to more effectively supply the solvent to the collecting member.

Example 3. In the substrate processing apparatus of Example 1 or Example 2, the multiple communication holes may include a communication hole whose diameter is increased as it goes from the outer storage space to the inner storage space. In this case, when the solvent is introduced into the inner storage space through the multiple communication holes, the flow velocity of the solvent is decreased. For this reason, it becomes easy for the solvent introduced into the inner storage space to spread within the inner storage space with a good balance. Therefore, the flow rate of the solvent dropping from the multiple dripping holes becomes more uniform. Accordingly, it is possible to more effectively remove the entangled lump collected in the collecting member.

Example 4. In the substrate processing apparatus of any one of Example 1 to Example 3, the inlet hole may be disposed not to overlap the multiple communication holes in a diametrical direction of the substrate as viewed from above. In this case, it is possible to suppress the solvent, which has been introduced into the outer storage space from the inlet hole, from being immediately flown to a specific communication hole, so that an easy introduction of the solvent into the inner storage space from the specific communication hole can be suppressed. For this reason, it becomes easy for the solvent to be more uniformly introduced into the inner storage space. Therefore, the flow rate of the solvent dropping from the multiple dripping holes becomes more uniform. Accordingly, it is possible to more effectively remove the entangled lump collected in the collecting member.

Example 5. In the substrate processing apparatus of Example 4, the inlet hole may be disposed to diametrically overlap a region of the partition wall corresponding to an approximately middle of two adjacent communication holes of the multiple communication holes in the circumferential direction as viewed from above. In this case, the solvent introduced from the inlet hole collides first with the partition wall and then flows along the circumferential direction to fill the outer storage space. For this reason, it becomes easy for the solvent to be more uniformly introduced into the inner storage space.

Example 6. In the substrate processing apparatus of any one of Example 1 to Example 5, the solvent supply may further include an additional inner storage space located above the inner storage space and configured to surround the substrate as viewed from above. The partition wall may partition the inner storage space, the additional inner storage space and the outer storage space; the additional inner storage space may include multiple additional dripping holes arranged at a predetermined interval along the circumferential direction; the partition wall may include multiple additional communication holes arranged at a predetermined interval along the circumferential direction; the multiple additional communication holes may be extended to penetrate the partition wall such that the solvent introduced into the outer storage space flows to the additional inner storage space; and the multiple additional dripping holes may be extended to penetrate a bottom wall of the additional inner storage space such that the solvent within the additional inner storage space drops downwards. In this case, the solvent is discharged from each of the multiple dripping holes, and, thus, the solvent is supplied not only to the collecting member but also to the inner wall surface of the cover member. Therefore, it is possible to effectively remove the entangled lump on the inner wall surface.

Example 7. In the substrate processing apparatus of any one of Example 1 to Example 5, the solvent supply may further include additional inner storage space located above the inner storage space and configured to surround the substrate as viewed from above; and additional outer storage space located above the outer storage space and configured to surround the additional inner storage space as viewed from above. The partition wall may partition the inner storage space, the outer storage space, the additional inner storage space and the additional outer storage space; the additional inner storage space may include multiple additional dripping holes arranged at a predetermined interval along the circumferential direction; the additional outer storage space may include an additional inlet hole through which the solvent is introduced; the partition wall may include multiple additional communication holes arranged at a predetermined interval along the circumferential direction; the multiple additional communication holes may be extended to penetrate the partition wall such that the solvent introduced into the additional outer storage space flows to the additional inner storage space; and the multiple additional dripping holes may be extended to penetrate a bottom wall of the additional inner storage space such that the solvent within the additional inner storage space drops downwards. In this case, the same effects as in Example 6 can be obtained. Also, in this case, the solvent flowing through the outer storage space and the inner storage space and the solvent flowing through the additional outer storage space and the additional inner storage space are independent of each other. Therefore, the flow rate of the solvent discharged from the multiple dripping holes and the flow rate of the solvent discharged from the multiple additional dripping holes do not affect each other. Thus, the flow rate of the solvent dropping from the dripping holes and the flow rate of the solvent dropping from the multiple additional dripping holes become approximately uniform. Accordingly, it is possible to more effectively remove the entangled lump.

Example 8. In the substrate processing apparatus of Example 6 or Example 7, the solvent supply may further include a protrusion member protruding downwards from a lower surface of the bottom wall of the additional inner storage space. The multiple additional dripping holes may include an additional dripping hole which is extended to penetrate the additional inner storage space and the protrusion member. In this case, the solvent discharged from the additional dripping hole is hardly attracted to the solvent discharged from the multiple dripping holes due to the surface tension, and, thus, it becomes easy for the solvent to drop downwards from the lower end of the protrusion member. For this reason, the solvent can effectively drop from the additional dripping hole to the inner wall surface of the cover member. Therefore, it is possible to more effectively clean the entangled lump on the inner wall surface.

Example 9. The substrate processing apparatus of any one of Example 1 to Example 8 may further include a controller configured to control the solvent supply. The controller may control the solvent supply to drop the solvent from the multiple dripping holes when the collecting member is in a dry state. In this case, when the solvent is needed, the solvent is supplied to the collecting member. Therefore, it is possible to reduce the consumption amount of the solvent and effectively remove the entangled lump.

Example 10. The substrate processing apparatus of Example 9 may further include additional solvent supply configured to supply a solvent to the substrate. The controller may control the solvent supply to drop the solvent from the multiple dripping holes when a new solvent is not supplied from the additional solvent supply while a predetermined time period elapses after the solvent is supplied from the solvent supply or the additional solvent supply. In this case, the predetermined time period is set shorter than the vaporization time of the solvent, and, thus, before the collecting member is dried, the solvent is automatically supplied to the collecting member. Therefore, it is possible to reduce the consumption amount of the solvent and effectively and automatically remove the entangled lump.

Example 11. The substrate processing apparatus of Example 9 may further include a sensor configured to detect the dry state of the collecting member. The controller may control the solvent supply to drop the solvent from the multiple dripping holes when the sensor detects the dry state of the collecting member. In this case, the dry state of the collecting member can be more accurately detected by the sensor. For this reason, before the collecting member is dried, the minimum required amount of the solvent is automatically supplied to the collecting member. Therefore, it is possible to further reduce the consumption amount of the solvent and effectively and automatically remove the entangled lump.

Example 12. In the substrate processing apparatus of any one of Example 1 to Example 11, the coating liquid may have a viscosity of 100 cP or more. In this case, even when the coating liquid having a high viscosity at which the entangled lump can be easily generated is used, it is possible to suppress the generation of the entangled lump.

According to the exemplary embodiments, a substrate processing apparatus can effectively remove the entangled lump.

From the foregoing, it will be appreciated that various exemplary embodiments of the present disclosure have been described herein for the purposes of illustration, and that various modifications may be made without departing from the scope and spirit of the present disclosure. Accordingly, the various exemplary embodiments disclosed herein are not intended to be limiting, with the true scope and spirit being indicated by the following claims.

We claim:

1. A substrate processing apparatus, comprising:

a rotary holder configured to hold and rotate a substrate;

a coating liquid supply configured to supply a coating liquid to the substrate;

a cover member placed to surround the substrate held by the rotary holder;

a collecting member placed in an exhaust path formed between the cover member and the rotary holder; and a solvent supply placed above the collecting member and configured to supply a solvent to the collecting member, wherein the solvent supply includes:

an inner storage space configured to surround the substrate as viewed from above;

an outer storage space configured to surround the inner storage space as viewed from above; and a partition wall extending along a circumferential direction of the substrate to partition the inner storage space and the outer storage space, and wherein the inner storage space includes multiple dripping holes arranged at a predetermined interval along the circumferential direction, the outer storage space includes an inlet hole through which the solvent is introduced, the partition wall includes multiple communication holes arranged at a predetermined interval along the circumferential direction, the multiple communication holes are extended to penetrate the partition wall such that the solvent introduced into the outer storage space flows to the inner storage space, and the multiple dripping holes are extended to penetrate a bottom wall of the inner storage space such that the solvent within the inner storage space drops toward the collecting member.

2. The substrate processing apparatus of claim 1, wherein the solvent supply further includes a protrusion member protruding from a lower surface of a bottom wall of the solvent supply toward the collecting member located under the bottom wall.

3. The substrate processing apparatus of claim 1, wherein the multiple communication holes include a communication hole whose diameter is increased as it goes from the outer storage space to the inner storage space.

4. The substrate processing apparatus of claim 1, wherein the inlet hole is disposed not to overlap the multiple communication holes in a diametrical direction of the substrate as viewed from above.

5. The substrate processing apparatus of claim 4, wherein the inlet hole is disposed to diametrically overlap a region of the partition wall corresponding to an approximately middle of two adjacent communication holes of the multiple communication holes in the circumferential direction as viewed from above.

6. The substrate processing apparatus of claim 1, wherein the solvent supply further includes an additional inner storage space located above the inner storage space and configured to surround the substrate as viewed from above, the partition wall partitions the inner storage space, the additional inner storage space and the outer storage space, the additional inner storage space includes multiple additional dripping holes arranged at a predetermined interval along the circumferential direction, the partition wall includes multiple additional communication holes arranged at a predetermined interval along the circumferential direction, the multiple additional communication holes are extended to penetrate the partition wall such that the solvent introduced into the outer storage space flows to the additional inner storage space, and the multiple additional dripping holes are extended to penetrate a bottom wall of the additional inner storage space such that the solvent within the additional inner storage space drops downwards.

7. The substrate processing apparatus of claim 1, wherein the solvent supply further includes:

additional inner storage space located above the inner storage space and configured to surround the substrate as viewed from above; and additional outer storage space located above the outer storage space and configured to surround the additional inner storage space as viewed from above, and wherein the partition wall partitions the inner storage space, the outer storage space, the additional inner storage space and the additional outer storage space, the additional inner storage space includes multiple additional dripping holes arranged at a predetermined interval along the circumferential direction, the additional outer storage space includes an additional inlet hole through which the solvent is introduced, the partition wall includes multiple additional communication holes arranged at a predetermined interval along the circumferential direction, the multiple additional communication holes are extended to penetrate the partition wall such that the solvent introduced into the additional outer storage space flows to the additional inner storage space, and the multiple additional dripping holes are extended to penetrate a bottom wall of the additional inner storage space such that the solvent within the additional inner storage space drops downwards.

8. The substrate processing apparatus of claim 6, wherein the solvent supply further includes a protrusion member protruding downwards from a lower surface of the bottom wall of the additional inner storage space, and the multiple additional dripping holes include an additional dripping hole which is extended to penetrate the additional inner storage space and the protrusion member.

9. The substrate processing apparatus of claim 1, further comprising:

a controller configured to control the solvent supply, wherein the controller controls the solvent supply to drop the solvent from the multiple dripping holes when the collecting member is in a dry state.

10. The substrate processing apparatus of claim 9, further comprising:

additional solvent supply configured to supply a solvent to the substrate, wherein the controller controls the solvent supply to drop the solvent from the multiple dripping holes when a new solvent is not supplied from the additional solvent supply while a predetermined time period elapses after the solvent is supplied from the solvent supply or the additional solvent supply.

11. The substrate processing apparatus of claim 9, further comprising:

a sensor configured to detect the dry state of the collecting member, wherein the controller controls the solvent supply to drop the solvent from the multiple dripping holes when the sensor detects the dry state of the collecting member.

12. The substrate processing apparatus of claim 1, wherein the coating liquid has a viscosity of 100 cP or more.

* * * * *